US009884502B2

(12) United States Patent
Faber

(10) Patent No.: US 9,884,502 B2
(45) Date of Patent: Feb. 6, 2018

(54) DEVICE FOR GUIDING AN INK PAD CONTAINER AND SELF-INKING STAMP

(71) Applicant: COLOP Stempelerzeugung Skopek Gesellschaft m.b.H. & Co. KG., Wels (AT)

(72) Inventor: Ernst Faber, Wels (AT)

(73) Assignee: COLOP Stempelerzeugung Skopek Gesellschaft m.b.H. & Co. KG., Wels (AT)

( * ) Notice: Subject to any disclaimer, the term of this patent is extended or adjusted under 35 U.S.C. 154(b) by 0 days.

(21) Appl. No.: 14/759,040

(22) PCT Filed: Jan. 21, 2014

(86) PCT No.: PCT/AT2014/050024
§ 371 (c)(1),
(2) Date: Jul. 2, 2015

(87) PCT Pub. No.: WO2014/113833
PCT Pub. Date: Jul. 31, 2014

(65) Prior Publication Data

US 2015/0343822 A1 Dec. 3, 2015

(30) Foreign Application Priority Data

Jan. 24, 2013 (AT) ..... A 50052/2013

(51) Int. Cl.
*B41K 1/36* (2006.01)
*B41K 1/40* (2006.01)
(Continued)

(52) U.S. Cl.
CPC ..... *B41K 1/36* (2013.01); *B41K 1/006* (2013.01); *B41K 1/02* (2013.01); *B41K 1/40* (2013.01); *B41K 1/54* (2013.01)

(58) Field of Classification Search
CPC . B41K 1/006; B41K 1/02; B41K 1/36; B41K 1/40; B41K 1/42; B41K 1/54
(Continued)

(56) References Cited

U.S. PATENT DOCUMENTS 454,499 A * 6/1891 Ryer ..... B41K 1/40 101/334
1,085,489 A * 1/1914 Rushworth ..... B41K 1/40 101/334
(Continued)

FOREIGN PATENT DOCUMENTS

AT 3176 U1 11/1999
AT 004 935 U1 1/2002
(Continued)

OTHER PUBLICATIONS

International Search Report in PCT/AT2014/050022, dated Jun. 4, 2014.
(Continued)

*Primary Examiner* — Matthew G Marini
*Assistant Examiner* — Marissa Ferguson Samreth
(74) *Attorney, Agent, or Firm* — Collard & Roe, P.C.

(57) ABSTRACT

A device (1) for guiding an ink pad container (2) into and/or out of a receiving space (3) in the stamp housing (4) of a self-inking stamp (5), comprising a drawer-type receiving container (6) for the ink pad container (2) which comprises, on one side, a free access opening (11) for pushing out and/or pushing in the ink pad container (2).

12 Claims, 20 Drawing Sheets

Figure 1:
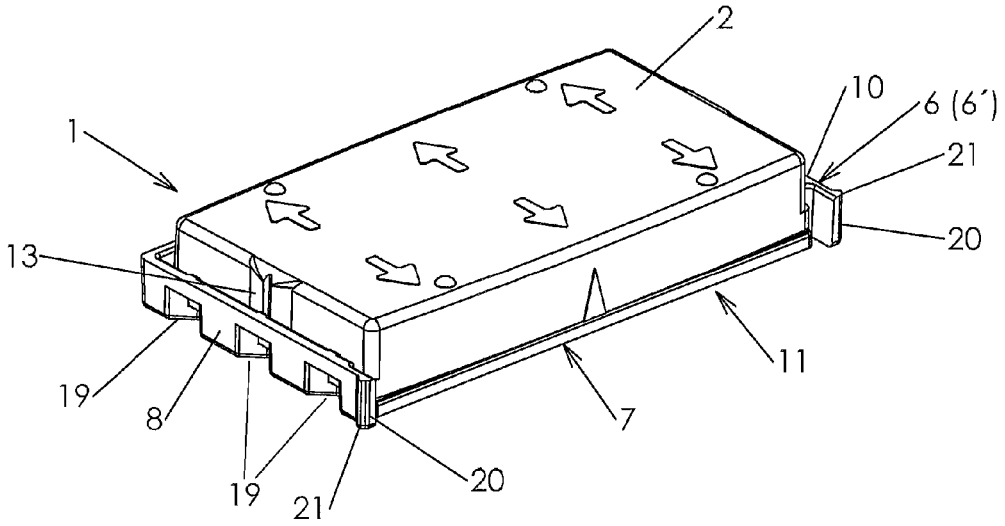

(51) Int. Cl.

| | |
|---|---|
| ***B41K 1/00*** | (2006.01) |
| ***B41K 1/02*** | (2006.01) |
| ***B41K 1/54*** | (2006.01) |

(58) Field of Classification Search
USPC ..... 101/327, 333, 334
See application file for complete search history.

(56) References Cited

U.S. PATENT DOCUMENTS

| | | | | |
|---|---|---|---|---|
| 3,063,371 | A | 11/1962 | Lowell et al. | |
| 4,579,057 | A | 4/1986 | Hewitt et al. | |
| 5,152,223 | A | 10/1992 | Mairon | |
| 5,463,947 | A | 11/1995 | Taira | |
| 5,505,130 | A | 4/1996 | Winston | |
| 5,517,916 | A | 5/1996 | Dour et al. | |
| 5,649,485 | A * | 7/1997 | Dour | B41K 1/40 101/104 |
| 5,743,186 | A | 4/1998 | Liao | |
| 5,768,992 | A | 6/1998 | Daw et al. | |
| 5,816,160 | A | 10/1998 | Taira et al. | |
| 6,067,905 | A | 5/2000 | Faber | |
| 6,761,114 | B2 | 7/2004 | Koneczny et al. | |
| 6,877,426 | B1 * | 4/2005 | Huang | B41K 1/38 101/104 |
| 6,994,025 | B1 | 2/2006 | Faber | |
| 7,066,089 | B1 | 6/2006 | Shih | |
| 7,069,852 | B2 | 7/2006 | Zindl et al. | |
| 7,086,331 | B2 | 8/2006 | Moody | |
| 7,267,054 | B2 | 9/2007 | Lien | |
| 7,389,727 | B2 | 6/2008 | Faber | |
| 7,464,643 | B2 | 12/2008 | Pointl | |
| 9,211,754 | B2 | 12/2015 | Zehetner et al. | |
| 2001/0027612 | A1 | 10/2001 | Barr | |
| 2004/0007144 | A1 | 1/2004 | Koneczny et al. | |
| 2004/0025727 | A1 | 2/2004 | Faber | |
| 2004/0035310 | A1 | 2/2004 | Zindl | |
| 2005/0056173 | A1 | 3/2005 | Dour | |
| 2005/0066828 | A1 | 3/2005 | Wei | |
| 2005/0145127 | A1 * | 7/2005 | Zindl | B41K 1/54 101/333 |
| 2006/0000374 | A1 | 1/2006 | Faber | |
| 2006/0162596 | A1 | 7/2006 | Faber | |
| 2006/0185539 | A1 * | 8/2006 | Faber | B41K 1/40 101/333 |
| 2007/0169650 | A1 | 7/2007 | Shih | |
| 2007/0272099 | A1 | 11/2007 | Pointl | |
| 2009/0229482 | A1 | 9/2009 | Shin | |
| 2010/0170813 | A1 | 7/2010 | Faber | |
| 2010/0300314 | A1 | 12/2010 | Chen | |
| 2011/0277647 | A1 | 11/2011 | Zindl et al. | |
| 2012/0297998 | A1 | 11/2012 | Zehetner et al. | |

FOREIGN PATENT DOCUMENTS

| | | | |
|---|---|---|---|
| AT | 6265 | U1 | 7/2003 |
| AT | 7861 | U1 | 10/2005 |
| AT | 507 692 | A1 | 7/2010 |
| AT | 507 833 | A2 | 8/2010 |
| AT | 414 342 | B | 9/2011 |
| AT | 511 453 | A4 | 12/2012 |
| CN | 2474313 | Y | 1/2002 |
| CN | 1655945 | A | 8/2005 |
| CN | 1704254 | A | 12/2005 |
| CN | 1761571 | A | 4/2006 |
| CN | 201169123 | Y | 12/2008 |
| CN | 102300716 | A | 12/2011 |
| CN | 102795004 | A | 11/2012 |
| DE | 634 393 | C | 8/1936 |
| DE | 32 00 551 | A1 | 7/1983 |
| DE | 69601069 | T2 | 6/1999 |
| EP | 0 803 372 | A1 | 10/1997 |
| EP | 0 807 531 | A1 | 11/1997 |
| EP | 1 280 669 | B1 | 2/2007 |
| EP | 1 603 754 | B1 | 8/2007 |
| EP | 1 603 755 | B1 | 8/2007 |
| FR | 2 127 114 | A5 | 10/1972 |
| WO | 01/83226 | A1 | 11/2001 |
| WO | 01/83227 | A1 | 11/2001 |
| WO | 2004/060685 | A1 | 7/2004 |
| WO | 2004/091923 | A1 | 10/2004 |
| WO | 2005/037565 | A1 | 4/2005 |
| WO | 2006/119597 | A2 | 11/2006 |

OTHER PUBLICATIONS

International Search Report in PCT/AT2014/050025, dated Aug. 11, 2014.
Austrian Office Action in A 50054/2013, dated Nov. 29, 2013, with English translation of relevant parts.
Anleitung zum Zusammensetzen der Stempel [Instruction for construction of the stamps] [online], [discovered on Nov. 29, 2013]. Discovered on the website: •URL:http//www.vistaprint.de/stempel-montage-anleitung.
aspx?GP=11%2f29%2f2013+5%3a29%3a37+Am
&GPS=3026443255&GNF=1•.
International Search Report of PCT/AT2014/050024, dated Jul. 8, 2014.
Austrian Office Action in A 50052/2013-1, dated Nov. 29, 2013, with English translation of relevant parts.
International Search Report of PCT/AT2014/050023, dated Jul. 16, 2014.
Austrian Office Action in A 50051/2013, dated Nov. 29, 2013, with an English translation of relevant parts.
Austrian Office Action in A 50053/2013, dated Nov. 29, 2013, with an English translation of relevant parts.
Chinese Office Action in CN 201480005925.3, dated Jul. 22, 2016.

* cited by examiner

DEVICE FOR GUIDING AN INK PAD CONTAINER AND SELF-INKING STAMP

CROSS REFERENCE TO RELATED APPLICATIONS

This application is the National Stage of PCT/AT2014/050024 filed on Jan. 21, 2014, which claims priority under 35 U.S.C. § 119 of Austrian Application No. A 50052/2013 filed on Jan. 24, 2013, the disclosure of which is incorporated by reference. The international application under PCT article 21(2) was not published in English.

The invention relates to a device for guiding an ink pad container into and/or out of a receiving space in a stamp housing of a self-inking stamp, comprising a drawer-type receiving container for the ink pad container which comprises, on one side, a free access opening for pushing out and/or pushing in the ink pad container.

Furthermore, the invention relates to a self-inking stamp with upper inking, comprising a stamp housing in which a receiving chamber for an ink pad container is provided.

EP 1 603 754 B1 discloses a self-inking stamp with upper inking and with an ink pad container. Such a hand stamp commonly comprises a stamp aggregate or a stamp unit adapted to be turned by 180° from an upper inking position to a lower printing position by means of a turning mechanism in the interior of the stamp housing. In the upper inking position, the resting position of the hand stamp, the stamp plate provided with stamp types (the stereotype plate) is in contact with the ink pad in the ink pad container.

The ink pad, and more exactly the ink pad container with the ink pad, is adapted to be pushed out or pushed in horizontally (in the case of a vertical stamp) from/into its receiving space or insertion chamber in the stamp housing, for instance, so as to saturate the ink pad with fresh stamping ink, or else to easily exchange the ink pad along with the container. This action is indeed not particularly cumbersome, but nevertheless frequently results in that the person pushing out or pushing in the ink pad unintentionally colors his or her fingers with the ink during this action.

AT 507 833 A2 discloses a guiding retainer referred to as a drawer which is used during the insertion of an ink pad container, but remains in the stamp housing together with the ink pad. This means, however, that the drawer is open at the same side as the ink pad container, i.e. enables access to the ink pad in order that the stamp plate can be in contact with the ink pad in the inserted state. It is understood that here, too, unintentional staining of the fingers may occur.

It is an object of the invention to find a remedy here and to suggest a device for guiding an ink pad container into and/or out of such a receiving space or insertion chamber, wherein it is possible to avoid without problems that the fingers get into contact with the ink pad and get stained during this action.

For solution of this object the invention provides a device as initially mentioned which is characterized in that the drawer-type receiving container (6) simultaneously forms a closing and sliding lid for the ink pad container (2) and is adapted to close the ink pad container (2) so as to avoid contact with the ink pad (2') contained therein. When using the present device, for instance in the case that an ink pad and/or and ink pad container is to be inserted into the self-inking stamp, the device, i.e. the receiving container, along with the ink pad container contained therein is held at the stamp housing and/or the actuating member of the self-inking stamp in the region of the opening of the receiving space, and the ink pad container along with the ink pad is then pushed out from this receiving container into the receiving space of the stamp housing. In the case of the removing of an ink pad container along with the ink pad from the receiving space of the stamp housing of the self-inking stamp the inverse process is performed, i.e. the guiding device is put to the opening of the receiving space and the ink pad container is pushed out of the receiving space in the stamp housing from the opposite side of the stamp housing, whereby it is pushed onto the device, i.e. the drawer-type receiving container.

The drawer-type receiving container forms a closing lid and/or pushing lid for the ink pad container, so that the removed ink pad container is closed by the drawer-type receiving container and consequently, unintentional contact with the ink pad and hence unintentional coloring of the fingers can be avoided.

The drawer-type receiving container could, for instance, be provided with lateral grip elements for manual gripping and holding, and it might have the most various shapes in plan view. It is, however, preferably adapted to the ink pad container and, for instance, generally rectangular in plan view and only slightly larger than the ink pad container which is, for instance, also rectangular. Since the receiving container can safely cover the ink pad container when it receives the latter, unproblematic seizing of the receiving container is even possible if it contains such an ink pad container with a saturated ink pad.

In principle the receiving container could comprise a bottom and an upper cover wall and furthermore side walls on three sides, i.e. form a kind of case with one open side, but preferably the receiving container is free at the upper side thereof, i.e. is formed without a cover wall, so that one can immediately recognize whether or not the receiving container contains an ink pad container.

Expediently, the receiving container comprises confining walls standing up from a bottom for retaining the ink pad container. Here, it is further favorable if a confining wall opposite to the free access opening comprises a central access recess for facilitating the manual pushing of the ink pad container off the receiving container. Moreover, it is also of advantage here if inwardly projecting edges are provided at opposite confining walls, said edges being adapted to cooperate with shoulders on opposite sides of the ink pad container for the retaining and guiding thereof. Moreover, it is preferred that the receiving container comprises latching and/or press fit projections on at least two confining walls for retaining the ink pad container.

The afore-mentioned confining walls may be continuous, i.e. extend along the entire length and/or breadth of the receiving container in the case of a rectangular shape, but they may theoretically also be formed discontinuously by wall members spaced apart from each other. In the case of a receiving container which is free at the upper side it is favorable if the confining walls extend only over a part of the height of an ink pad container received, which facilitates the pushing out of the ink pad container from the receiving container, on the one hand, and assists in saving material, on the other hand. In this case the afore-mentioned shoulders are arranged on the ink pad container at an appropriate distance, in practice relatively close to its open side which faces the bottom of the receiving container in the inserted position.

Preferably, the receiving container has a deepened bottom so as to avoid a contact of the bottom of the receiving container with the ink pad in the ink pad container, so that the bottom of the receiving container remains clean.

In the case of such a deepened bottom it is further favorable if opposite edges of the depression of the bottom form support guides for the ink pad container.

It has also turned out advantageous if the receiving container comprises depressions and/or breakthroughs at the outer side of two opposite sides. These lateral spaced-apart depressions and/or breakthroughs which are in particular provided in the bottom region offer advantages with respect to injection molding since they enable demolding without a slider after injection moulding of the receiving containers of plastics.

In order to achieve an exact orientation for a smooth movement during the pushing in or pushing out of an ink pad container relatively to its receiving chamber in the stamp housing it is of further advantage if insertion projections are provided laterally of the free access opening which are adapted to be inserted, during use, into corresponding recesses in the actuating member in the region of an opening of the receiving chamber in the stamp housing.

By means of the insertion projections and the corresponding insertion recesses a correct positioning of the receiving container at the stamp is thus enabled, irrespective of the fact that this position can then also be secured by means of the insertion projections, so that unintentional slipping out of position is avoided. In order to additionally improve the retention of the receiving container at the stamp housing it is further favorable if the insertion projections are formed with lateral latching elements, e.g. hooks, for latching to the wall members confining the recesses. Correspondingly, a self-inking stamp, as initially mentioned, for such receiving containers with insertion projections is characterized in that in the region of an opening of the receiving chamber in at least one wall of the actuating member recesses are provided in this wall which are adapted to cooperate with the aforementioned insertion projections. Since in the present case the self-inking stamp expediently does not comprise a receiving space for the ink pad container which is accessible from one side only, but a two-side possibility should be given for this purpose, it is finally also of advantage if the receiving space is formed as a through-hole in the stamp housing with one opening each at two opposite sides and/or walls of the stamp housing, and if recesses for the insertion projections are provided in the region of each of these openings in the actuating member.

Figure 6:
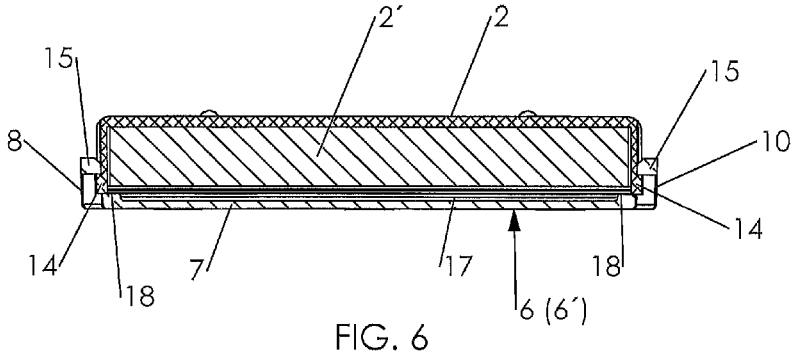
Figure 7:
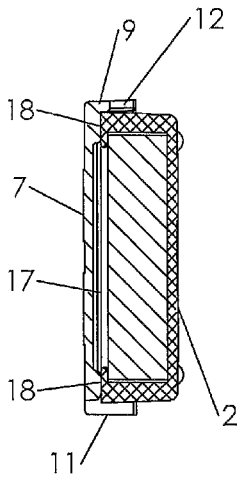
Figure 8:
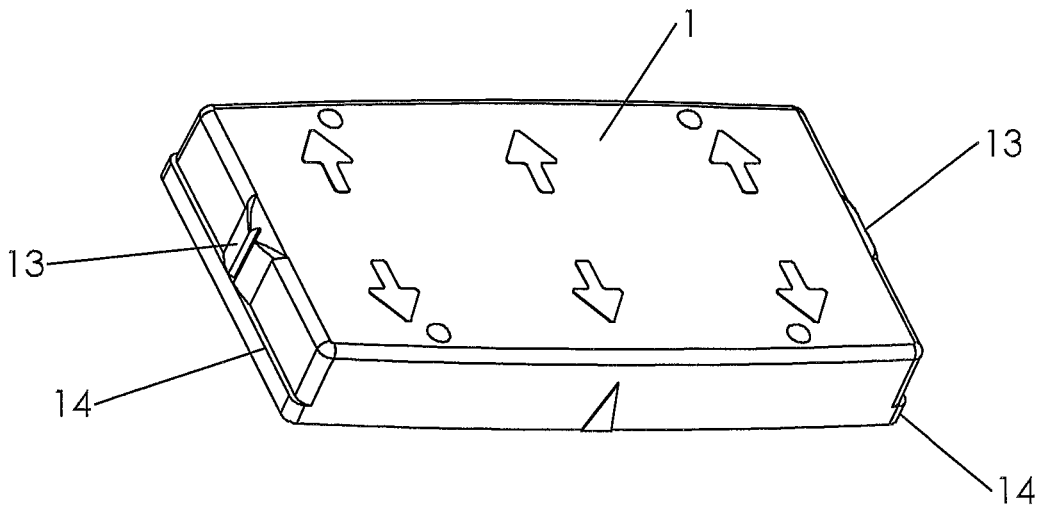
Figure 9:
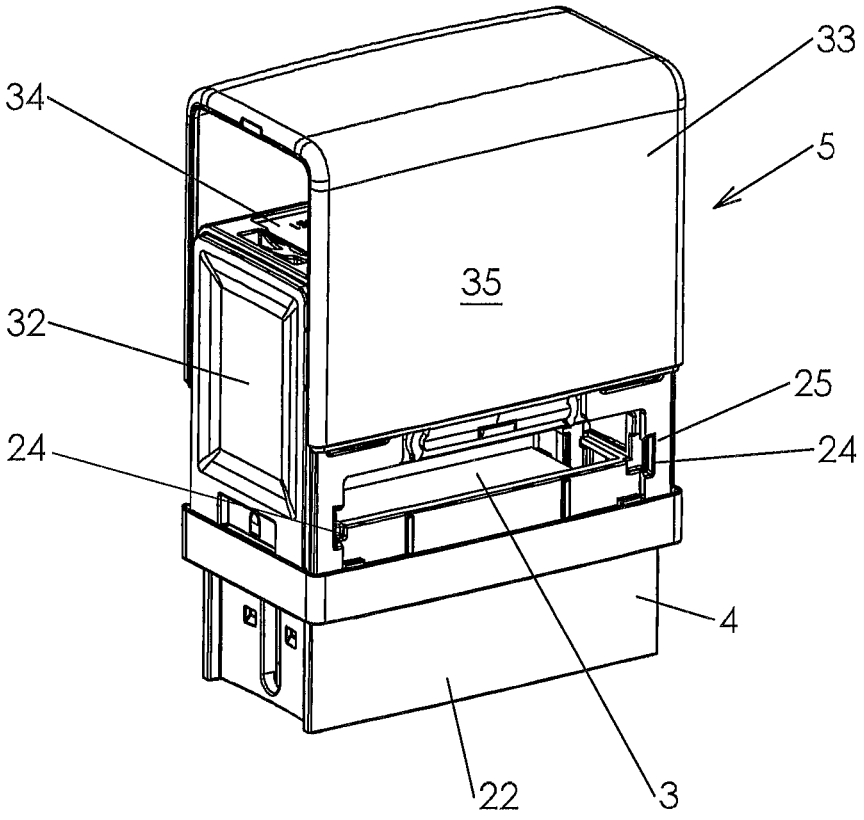
Figure 10A:
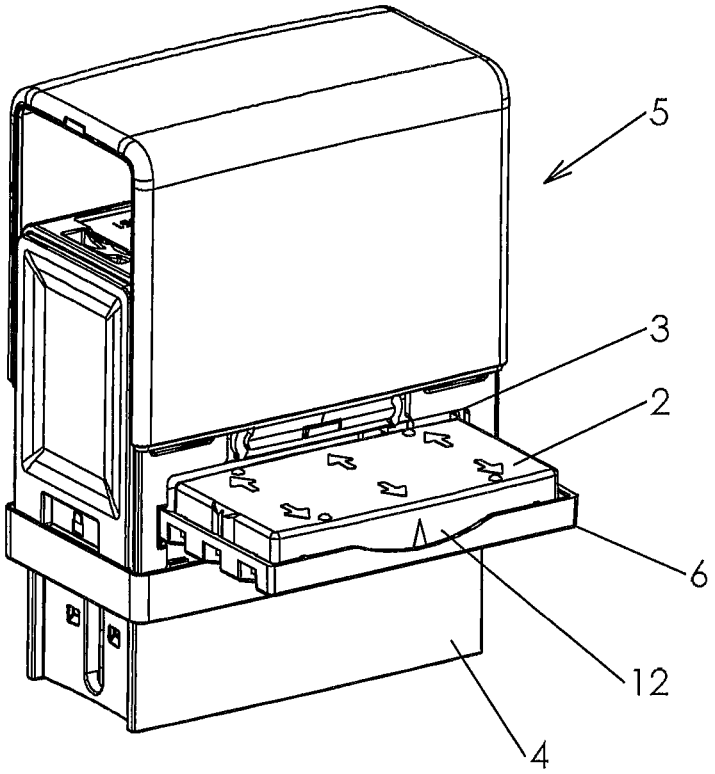
Figure 10B:
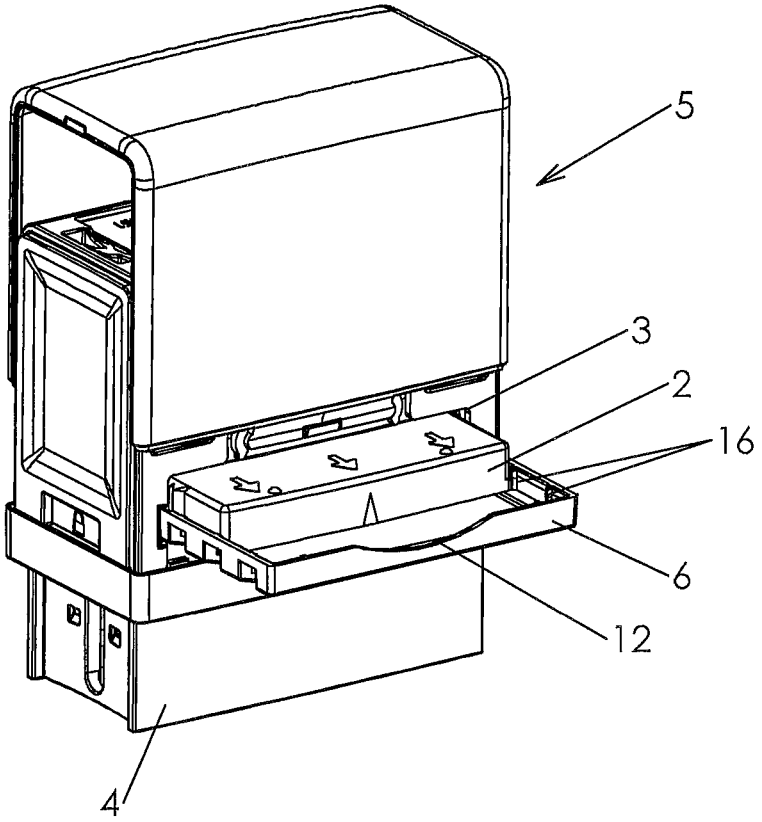
Figure 10C:
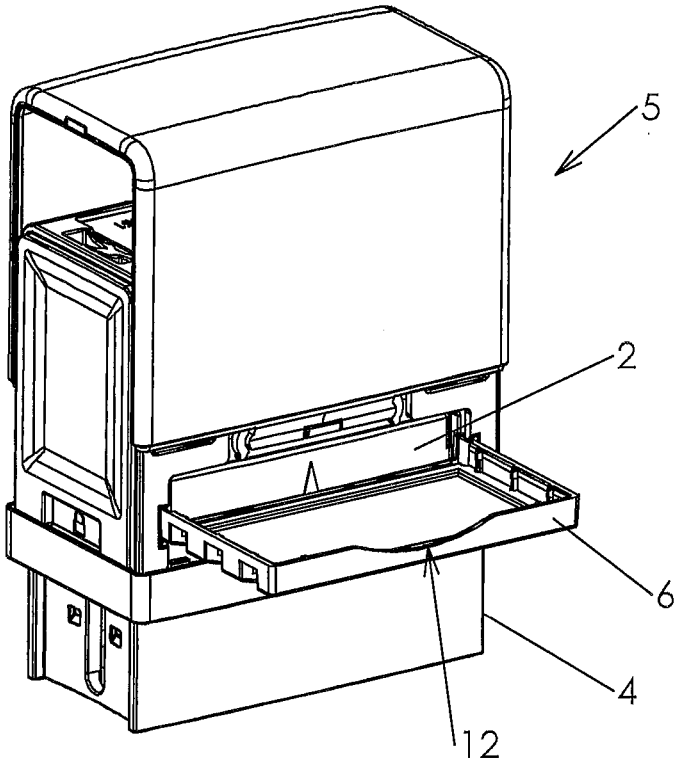
Figure 10D:
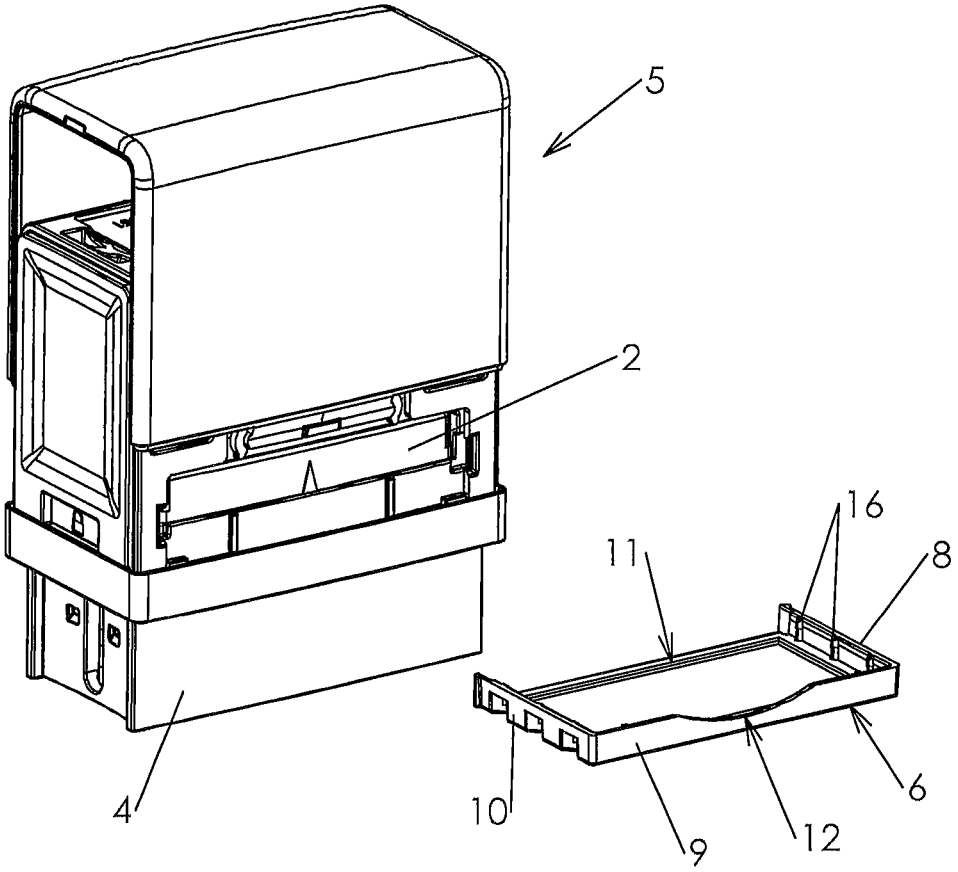
Figure 11A:
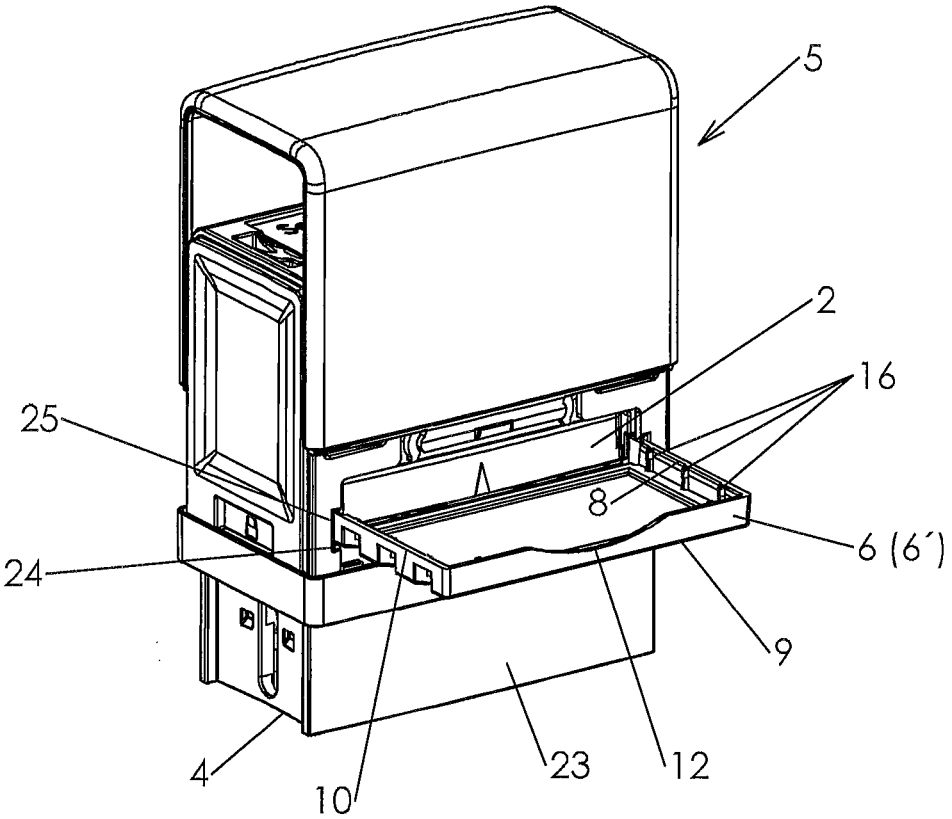
Figure 11B:
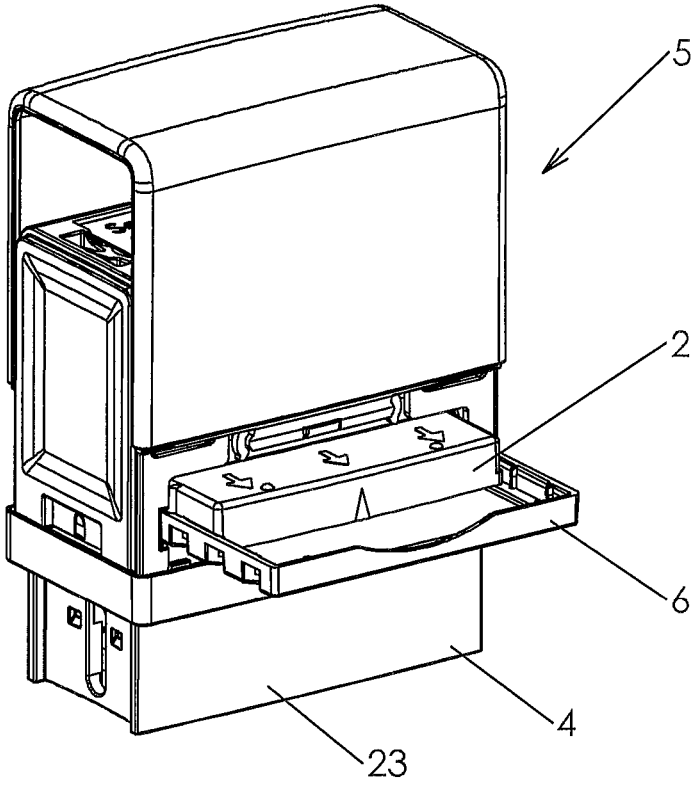
Figure 11C:
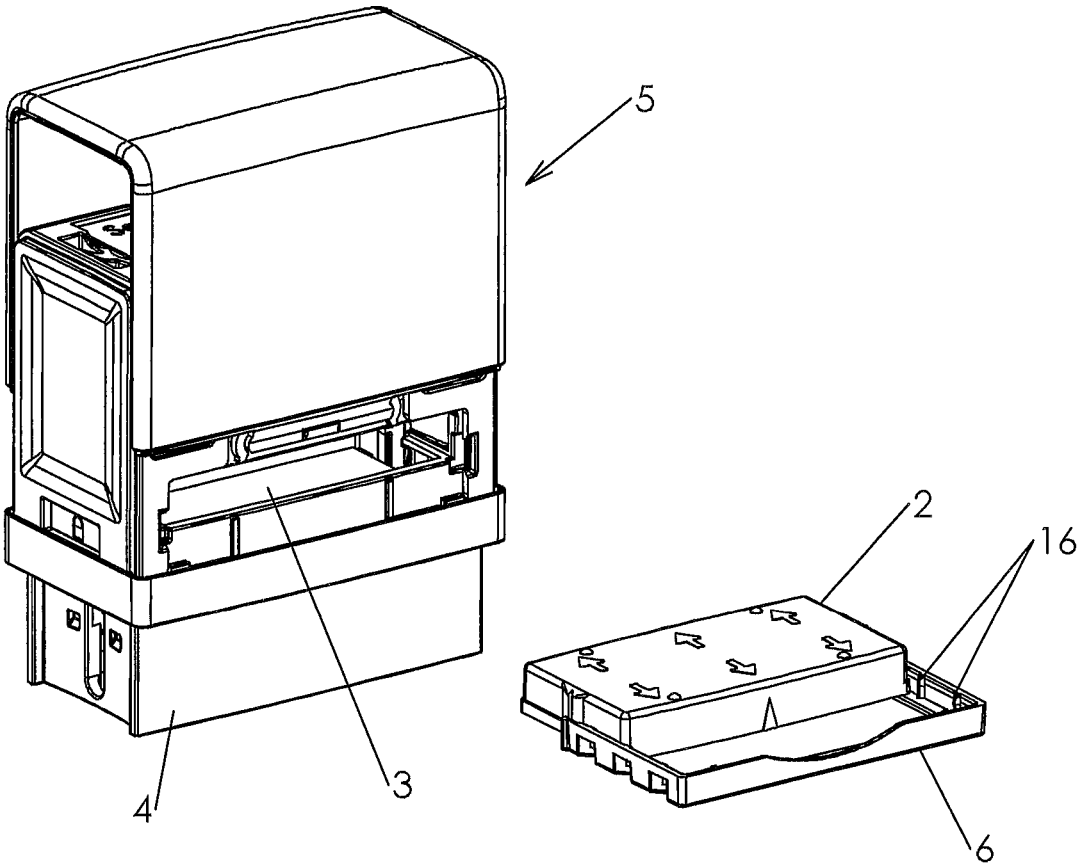
Figure 11D:
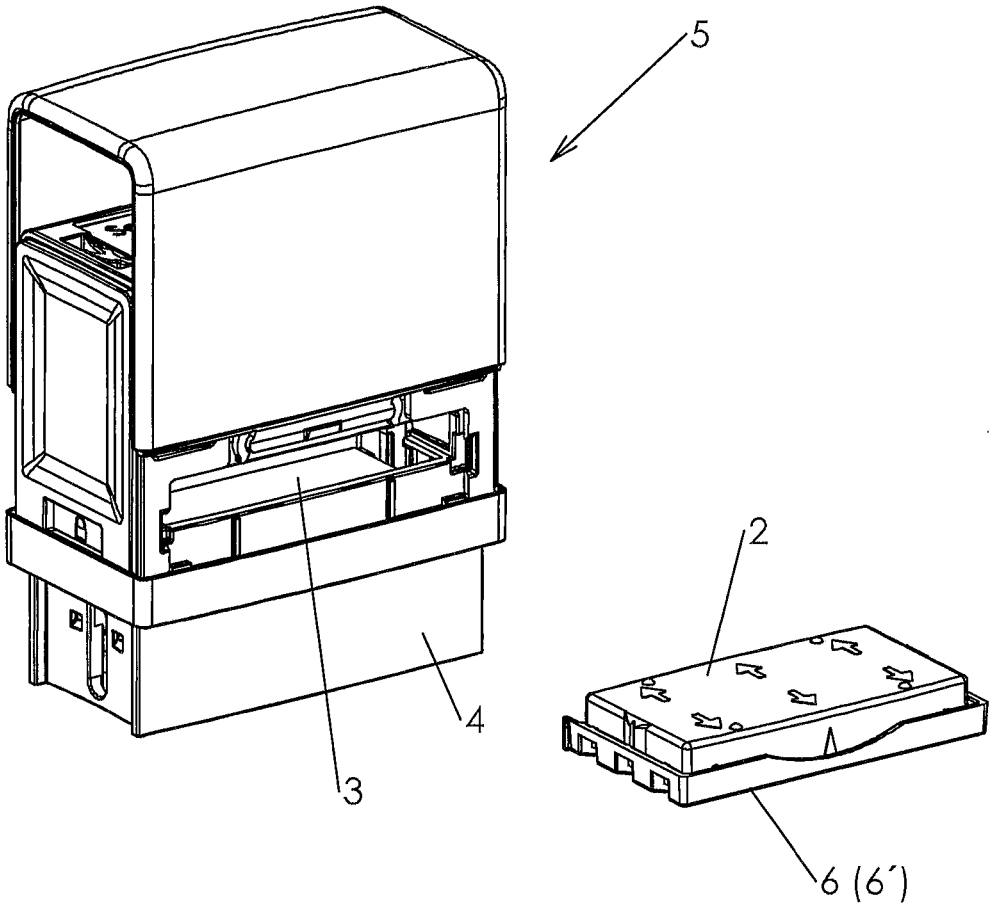
Figure 12A:
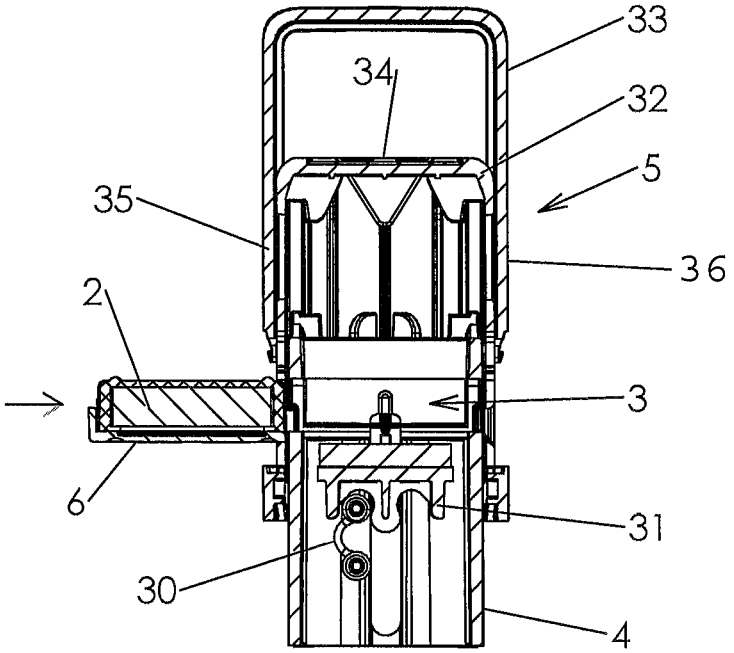
Figure 12B:
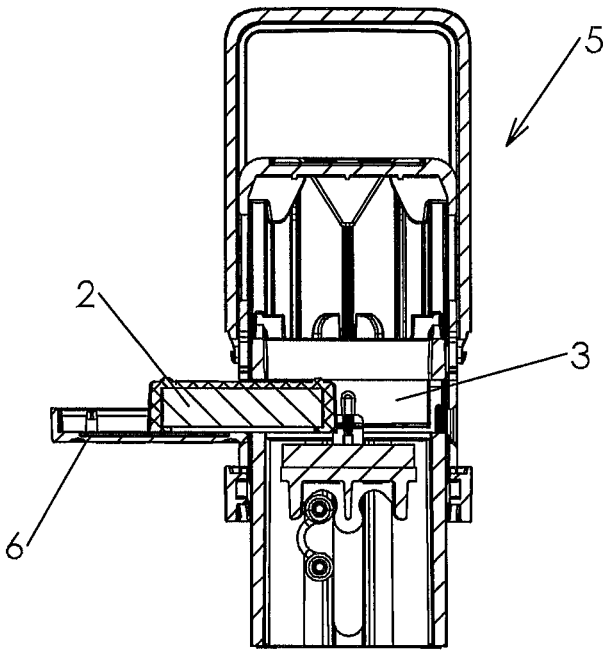
Figure 12C:
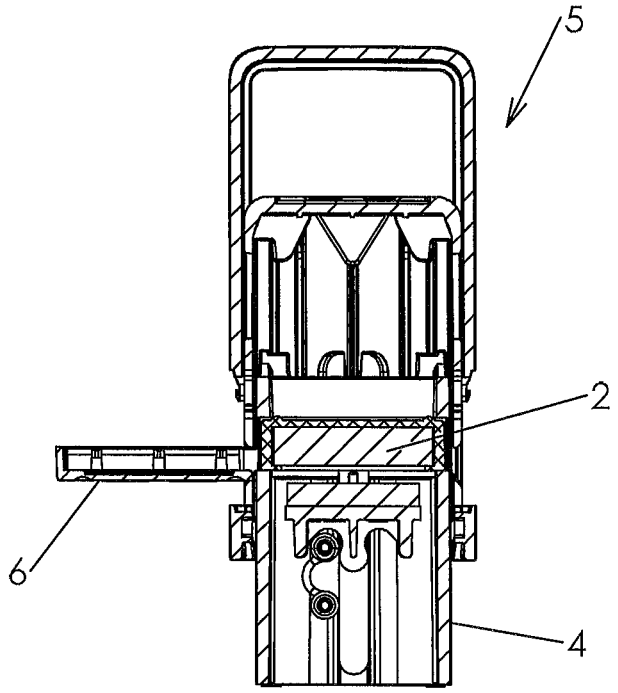
Figure 13A:
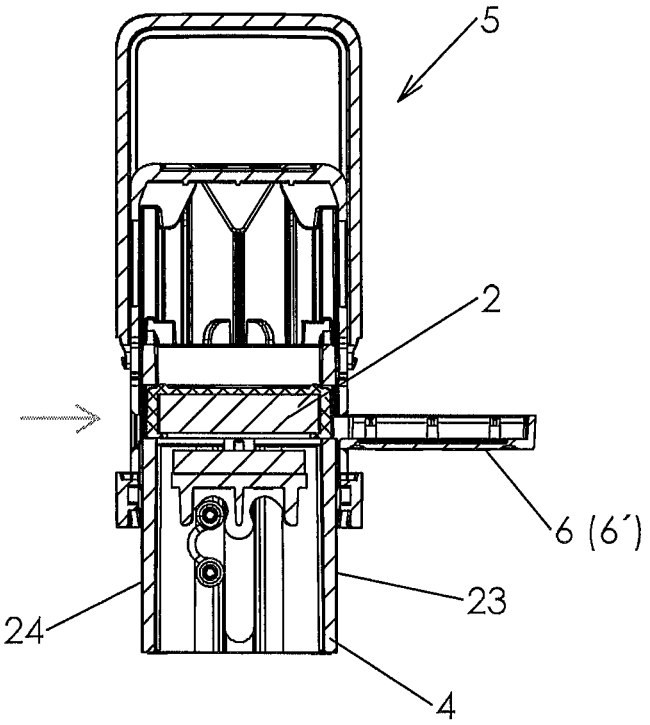
Figure 13B:
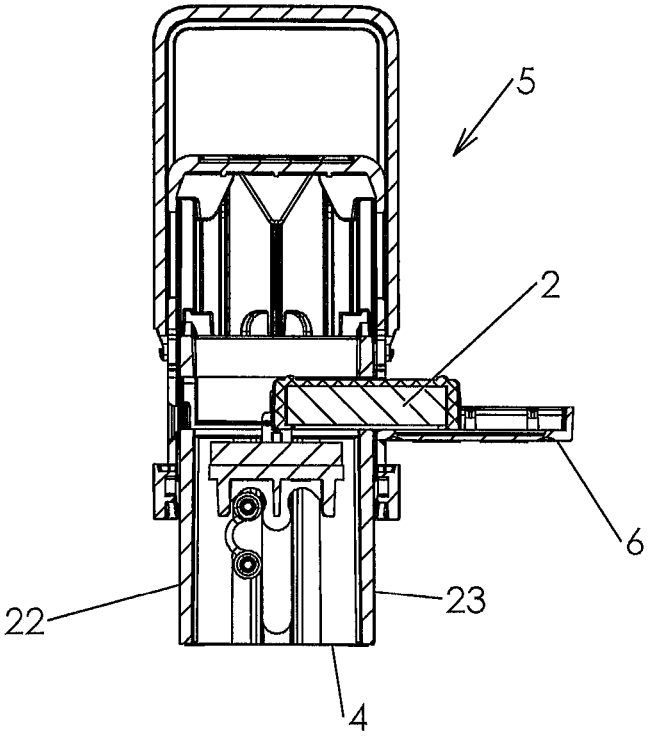
Figure 13C:
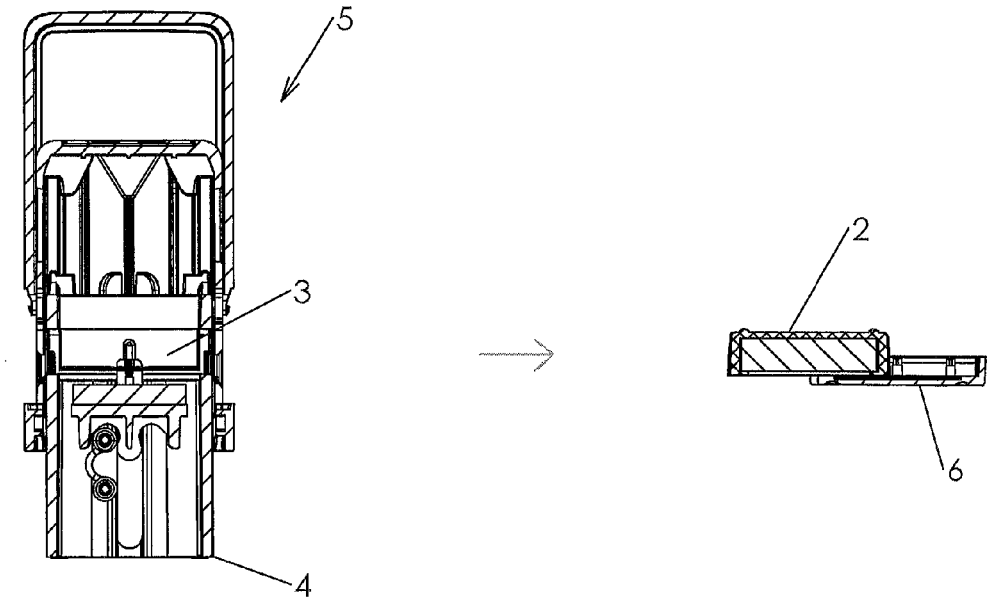
Figure 13D:
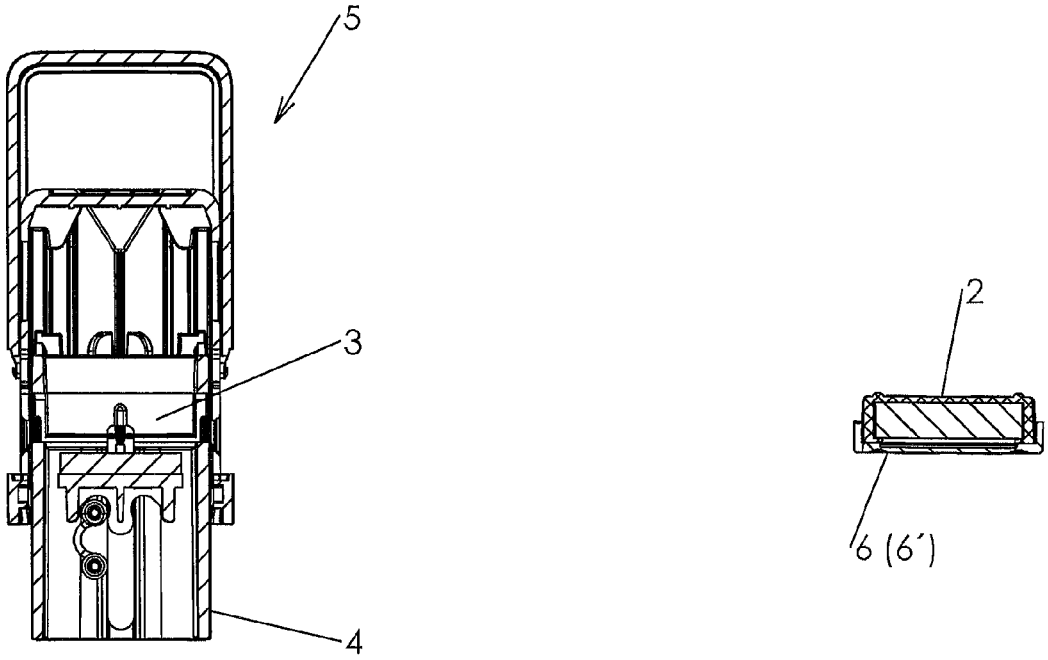

The invention will be explained in further detail in the following by means of particularly preferred embodiments which are illustrated in the drawing, but which the invention is not intended to be restricted to. The drawing shows in detail:

FIGS. 1-7 a device in the form of a drawer-type receiving container along with an ink pad container inserted therein in a slanted view from the front top (FIG. 1), in a slanted view from the rear bottom (FIG. 2), in a front view (FIG. 3), in a rear view (FIG. 4), in a plan view (FIG. 5), in a longitudinal section (FIG. 6), and in a cross section (FIG. 7);

FIG. 8 a slanted view of an ink pad container from the top;

FIG. 9 a self-inking stamp with a function that is per se known on principle, with an empty receiving space or chamber for an ink pad container;

FIGS. 10A-10D different phases during the pushing in of an ink pad container into the receiving space of the self-inking stamp pursuant to FIG. 9, namely in FIG. 10A with attached receiving container along with the ink pad container; in FIG. 10B with the ink pad container partially pushed into the receiving space; in FIG. 10C with the ink pad container completely pushed into the receiving space; and in FIG. 10D the self-inking stamp ready for use and, at a distance thereof, the receiving container which has been detached again and which is empty now;

FIGS. 11A-11D in a corresponding manner corresponding phases during the pushing out of an ink pad container from the receiving space of the self-inking stamp and into the receiving container which has been attached to the self inking stamp, more exactly to the stamp housing thereof (FIG. 11A), wherein finally (see FIG. 11D) the receiving container along with the ink pad container contained therein is detached from the self-inking stamp;

FIGS. 12A-12C in a way corresponding to FIGS. 10A-10C, in a cross section through the self-inking stamp and a receiving container along with an ink pad container, the phases during the pushing in of the ink pad container away from the receiving container into the receiving space in the self-inking stamp; and FIGS. 13A-13D in cross sections corresponding phases, cf. FIGS. 11A-11D, during the pushing out of the ink pad container from the receiving space in the self-inking stamp, namely onto a receiving container attached at the other side of the stamp housing which is finally, see FIGS. 13C and 13D, detached from the self-inking stamp and supplied and/or stored in some other place.

FIG. 1 illustrates in a diagrammatic view, slanted from above, a device 1 for guiding an ink pad container 2 into a receiving space 3 in a stamp housing 4 of a self-inking stamp 5 (see FIG. 9 and FIGS. 10A-10D), wherein this device 1 substantially consists of a drawer-type receiving container 6 (cf. in particular also FIGS. 100 and 10D). The drawer-type receiving container 6 comprises a bottom 7 and three side walls as confining walls 8, 9, 10. At the fourth side, namely the side opposite to the broad side 9, the drawer-type receiving container 6 comprises a free access opening 11 through which the ink pad container 2 can be pushed into and/or pushed out from the receiving container 6, as will be explained in detail in the following with reference to FIGS. 10A-13D. At the side opposite to this free access opening 11, in the broad side confining wall 9 available there, respectively, a central access recess 12 is provided, cf. in particular FIGS. 2 and 4, so as to have, from this side, the rear side, during the attaching of the receiving container 6 to a stamp housing 4 (see e.g. FIG. 10A), sufficient space for pushing the ink pad container 2 away from the receiving container 6 and into the receiving space 3 of the stamp housing 4.

Figure 2:
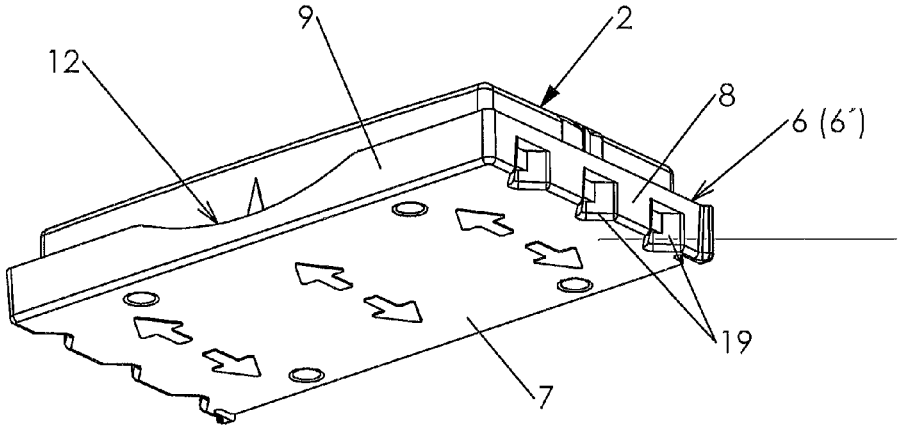
Figure 3:
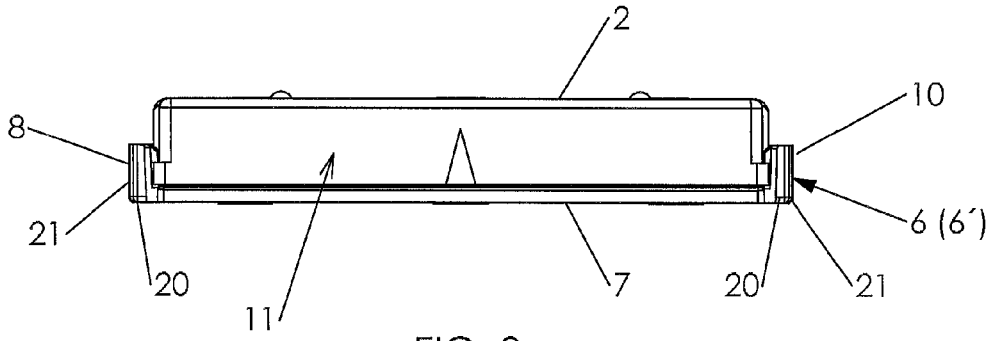
Figure 4:
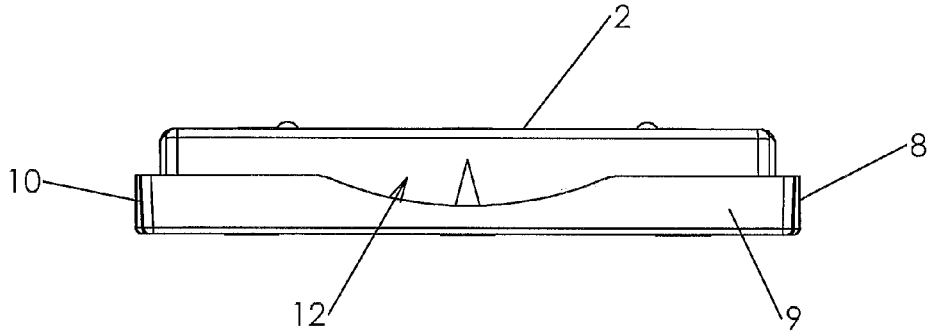

The ink pad container 2 is of basically conventional kind, cf. apart from FIG. 2 in particular also FIG. 8. It has central latching elements 13 at the two short sides thereof which cooperate in a per se known manner with associated latches (not illustrated) in the interior of the receiving space 3 in the stamp housing 4 so as to retain the ink pad container 2 in the receiving space 3 in the centered operating position. This operating position is, for instance, illustrated in FIG. 10 D and in FIG. 11A.

In particular in FIG. 8, ridges and/or shoulders 14, respectively, are further provided at the two short sides at the lower edge in the inserted operating position, which, as is illustrated in FIG. 6, cooperate in the state inserted into the receiving container 6 below inwardly projecting edges 15 at the narrow side confining walls 8, 10 for guiding and retaining the ink pad container 2 in the receiving container 6. Additionally, latching and/or press fit projections 16 are provided at the inner sides of these confining walls 8 and 10 for the frictionally engaged retention and/or latch-fixing of the ink pad container 2, as is illustrated in particular in FIG. 11A.

The bottom 7 of the receiving container 6 is deepened, as is in particular illustrated in the sectional views of FIGS. 6 and 7, wherein the depression 17 is confined at the two narrow sides and at the rear side as well as at the open front side by edges 18 forming supports and guides for the ink pad container 2.

The receiving container 6 is further provided at its two short sides, at the confining walls 8, 10 provided there, with inwardly projecting depressions and/or breakthroughs 19, namely at the positions of the inwardly projecting latching and/or press fit projections 16 available there, so as to enable demolding of the receiving containers 6 without a slider for the manufacturing by injection molding of plastics. These depressions and/or breakthroughs 19 may possibly lead to openings in the region of the bottom 7, so that the latching and/or press fit projections 16 and/or the corresponding wall regions of the confining walls 8, 10 are designed slightly resiliently in this region so as to favor the press fit, or the latching, respectively, of the ink pad holder 2 in the receiving container 6.

The short side confining walls 8, 9 comprise, at the front side of the receiving container 6, insertion projections 20 which are provided at their cantilevering front ends with laterally outwardly projecting latching elements 21, for instance, in the form of hooks. By means of these insertion projections 20 the receiving container 6 may be fixed at a broad side wall 22 or 23 of an actuating member 32 (see FIGS. 9 and/or 10A or 11A) in the region of recesses 24 laterally of the opening of the receiving space or receiving chamber 3 in the stamp housing 4, in that the insertion projections 20 with the latching elements 21 engage behind the wall members 25 laterally confining these recesses 24.

Figure 5:
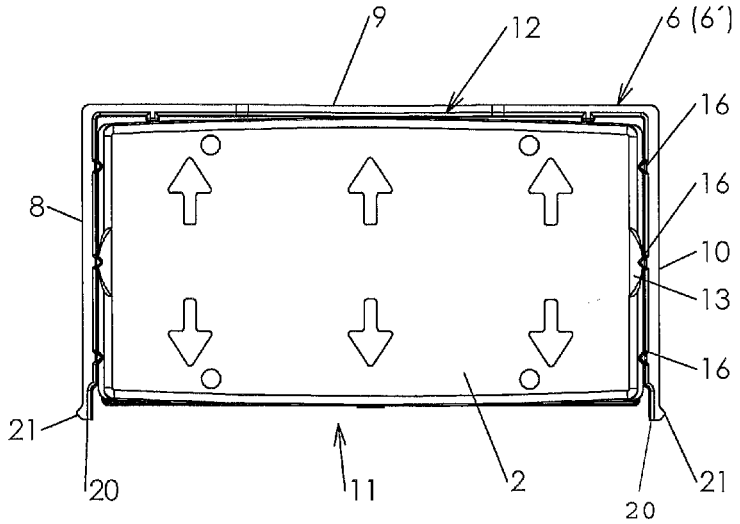

As may be seen in particular from FIG. 5, the latches 13 at the ink pad holder 2 are engaged, in the pushed-in position of the ink pad holder 2 in the receiving container 6, with the central latching and/or press fit projections 16 so as to ensure a particularly reliable retention of the ink pad container 2 in the receiving container 6 (or vice versa a strong hold of the receiving container 6 which forms a closing lid or a sliding lid 6' on the ink pad container).

In this closed position the receiving container 6, or the closing lid 6', respectively, covers with its bottom 7 the open side of the ink pad container 2 and thus forms a protection for the ink pad 2' contained in the ink pad container 2, cf. FIG. 6, wherein the depression 17 in the bottom 7 ensures a distance, i.e. a free space, between this bottom 7 and the ink pad 2' and hence avoids unintentional coloring of the bottom 7.

The self-inking stamp 5 illustrated in FIGS. 9-13 is of a per se conventional construction, as mentioned, wherein the turning mechanism 30 for the stamp plate unit 31 (which is per se known, as mentioned) is basically illustrated in FIG. 12A. Furthermore, the self-inking stamp 5 comprises an actuating member 32, see FIG. 9, which is, as usual, displaceable relatively to the stamp housing 4 against the force of a spring (not shown) so as to produce a stamp print. A window member 33 is slid over this actuating member 32, said window member consisting of a transparent material so as to be able to identify in particular a printing sheet 34 inserted at the upper side of the actuating member 32 through the upper side 35 of the window member 33. In FIGS. 9-13D the window member 33 is somewhat pushed upward from the actuating member 32 so as to expose the receiving drawer 3, which would otherwise be covered by the two walls 35, 36 of the window member 33, for the pushing in or the pushing out of the ink pad container 2.

The function of the actuating member 32 during the production of a print on a document, by turning the stamp unit 31, is per se known, cf. here, for instance, the initially mentioned EP 1 603 754 B1.

FIGS. 10A and 12A illustrate a receiving container 6 attached to the stamp 5, with an ink pad container 2 received therein. As mentioned, the insertion projections 20 engage with the hook latching elements 21 behind the wall members 25 which confine the lateral recesses 24 (FIG. 9). From this position according to FIGS. 10A and/or 12A the ink pad container 2 is pushed, for instance, with a finger, in the region of the access recess 12 inwardly in the direction of the interior of the receiving chamber or receiving space 3 at the stamp housing 4, cf. the intermediate position according to FIGS. 10B and 12B.

With reference to FIGS. 10C and/or 12C, the ink pad container 2 is already received completely in its desired position in the receiving space 3 in the stamp housing 4, and the receiving container 6 attached to the stamp housing 4 is empty. This empty receiving container 6 may then, as is illustrated in FIG. 10D, again be detached from the stamp housing 4 so as to receive another ink pad container 2, for instance, for a later time or for another self-inking stamp.

In the instant embodiment the self-inking stamp 5 is designed to be double-sided and/or symmetrical as concerns the receiving space 3 and its openings at the side walls 22, 23 of the stamp housing 4. In order to illustrate this similarity of the two sides of the stamp housing 4, i.e. the walls 22, 23, FIGS. 11A-13D illustrate a proceeding during the detaching of an ink pad container 2 in which the receiving container 6 for the ink pad container 2 is attached at the opposite side of the stamp (see wall 23 of the stamp housing 4) in the described manner and is locked with the insertion protections 20 behind the wall members 25 adjacent to the recesses 24 at this side of the actuating member 32. In accordance with the illustration in FIGS. 11A and 13A, the ink pad container 2 is still in its operating position inside the stamp housing 4, in its receiving space 3. The receiving container 6 and/or lid 6' is empty in this stage.

From the opposite side where the wall 22 of the stamp housing 4 is positioned (see FIGS. 13A and 13B), pressure is now exerted on the ink pad container 2, for instance with a finger, to the right according to the illustration in FIG. 13A, so as to release the latching by means of the latching elements 13 in the receiving space 3 and to thus push the ink pad container 2 in the direction of the receiving container 6, cf. FIGS. 11B and/or 13B. With the finger or possibly a thin object such as, for instance, a pencil, it is then possible—if necessary—to push the ink pad container 2 from this intermediate position further outward. It is easier, starting out from the position pursuant to FIGS. 11B and/or 13B, to detach the ink pad container 2 along with the receiving container 6 from the stamp 5, as is illustrated in FIGS. 11C and/or 13C.

Finally, as is shown in FIGS. 11D and/or 13D, the ink pad container 2 is completely pushed into the receiving container 6, so that he receiving container 6 as a lid 6' now covers, or closes, respectively, the open side of the ink pad container 2 where the ink pad 2 (see FIG. 6) would be exposed.

Although the invention has been explained above in detail by means of preferred embodiments, it is to be understood that variations and modifications are possible within the scope of the invention. For instance, the cross section of the stamp housing 4 and thus also the shape of the ink pad container 2 and in further consequence of the receiving container 6 could, for instance, also be square in plan view, and it would also be conceivable to use stamp plates which are circular in plan view. It would also be possible for the window member to be attached at the upper side of the actuating member only, as is illustrated in the afore-mentioned EP 1 603 754 B1, wherein a previous pushing up of a window member would then not be necessary when an ink pad container 2 is to be slid into or removed from the receiving space 3. The confining walls 8, 9, 10 could also be discontinuous, as mentioned, and the upper side of the receiving container 6 could in principle also be closed—at least partially—with a wall. The receiving container 6 may preferably be an injection molding part of plastics, e.g. ABS, PDM, or the like.

The invention claimed is:

1. An auxiliary device for a self-inking stamp, the auxiliary device comprising a drawer-type receiving container configured to accommodate an ink pad container, the drawer-type receiving container comprising:

a rectangular bottom, confining walls standing up from the rectangular bottom on three sides, for retaining the ink pad container, on a fourth side thereof, a free access opening for pushing out and/or pushing in the ink pad container, and insertion projections at the fourth side and lateral from the free access opening of the receiving container, said insertion projections of the receiving container being adapted to be hookingly inserted, in use, into corresponding engagement recesses in a front wall of the self-inking stamp to cause the drawer-type receiving container to cantilever from the front wall, said engagement recesses being provided laterally of an opening of a receiving space for the ink pad container in a stamp housing of the self-inking stamp, wherein the rectangular bottom of the drawer-type receiving container faces the ink pad and further defines a removable closure for the ink pad container when the ink pad container is outside of the self-inking stamp.

2. The auxiliary device according to claim 1, wherein the drawer-type receiving container is free at the upper side thereof.

3. The auxiliary device according to claim 1, wherein a confining wall positioned opposite of the free access opening comprises a central access recess for the manual pushing of the ink pad container off the drawer-type receiving container.

4. The auxiliary device according to claim 1, wherein inwardly projecting edges are provided at opposite walls, said edges being adapted to cooperate with shoulders at opposite sides of the ink pad container for the retaining and guiding thereof.

5. The auxiliary device according to claim 1, wherein the drawer-type receiving container comprises latching and/or press fit projections on at least two confining walls for retaining the ink pad container.

6. The auxiliary device according to claim 1, wherein the drawer-type receiving container has a deepened bottom forming a depression.

7. The auxiliary device according to claim 6, wherein opposite edges of the depression of the bottom form support guides for the ink pad container.

8. The auxiliary device according to claim 1, wherein the drawer-type receiving container comprises depressions and/or breakthroughs at the outer side of two opposite sides.

9. The auxiliary device according to claim 1, wherein the drawer-type receiving container is generally rectangular in plan view.

10. The auxiliary device according to claim 1, wherein for the insertion projections to be hookingly inserted into the engagement recesses in the front wall of the self-inking stamp the insertion projections are formed with hooks for latching with wall portions confining the engagement recesses.

11. A self-inking stamp with upper inking, comprising an actuating member and a stamp housing in which a receiving space for an ink pad container is provided, wherein laterally from an opening of the receiving space in at least one wall of the actuating member engagement recesses are provided in said wall which are adapted to cooperate with insertion projections of an auxiliary device according to claim 1.

12. The self-inking stamp according to claim 11, wherein the receiving space is formed as a through-hole in the ink housing, comprising one opening each at two opposite sides, or walls, respectively, of the stamp housing, and wherein engagement recesses for the insertion projections are provided laterally from each of these openings in the actuating member.

* * * * *